US006494710B2

(12) United States Patent
Kim et al.

(10) Patent No.: US 6,494,710 B2
(45) Date of Patent: Dec. 17, 2002

(54) METHOD AND APPARATUS FOR INCREASING INCINERATION CAPACITY OF THE GROUND FLARES BY USING THE PRINCIPLE OF TORNADO

(75) Inventors: Jong Soo Kim, Seoul (KR); Choong Hoon Lee, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 0 days.

(21) Appl. No.: 09/749,952

(22) Filed: Dec. 29, 2000

(65) Prior Publication Data

US 2002/0045141 A1 Apr. 18, 2002

(30) Foreign Application Priority Data

Aug. 22, 2000 (KR) ..... 2000-48568

(51) Int. Cl.[7] ..... F23G 7/08; F23J 15/00

(52) U.S. Cl. ..... 431/202; 431/5; 431/176; 431/9

(58) Field of Search ..... 431/176, 5, 202, 431/518, 154, 180, 174, 185, 350–353, 285, 9; 60/272, 39.06, 273; 422/198, 199; 588/210; 126/222, 223, 225

(56) References Cited

U.S. PATENT DOCUMENTS

| | | | | | |
|---|---|---|---|---|---|
| 1,816,434 | A | * | 7/1931 | Kaemmerling | 431/173 |
| 1,910,893 | A | * | 5/1933 | Frisch | 431/176 |
| 2,097,255 | A | * | 10/1937 | Saha | 110/342 |
| 2,464,791 | A | * | 3/1949 | Bonvillian et al. | 431/172 |
| 3,014,523 | A | * | 12/1961 | Huge | 431/176 |
| 3,185,202 | A | * | 5/1965 | Mitchel et al. | 431/173 |
| 3,822,985 | A | * | 7/1974 | Straitz, III | 431/202 |
| 3,868,210 | A | * | 2/1975 | Simpson et al. | 431/202 |
| 3,893,810 | A | * | 7/1975 | Lientz | 422/111 |
| 4,140,471 | A | * | 2/1979 | Straitz et al. | 431/202 |
| 4,166,421 | A | * | 9/1979 | Stribling | 110/171 |
| 4,218,426 | A | * | 8/1980 | Dahmen | 110/345 |
| 4,672,900 | A | * | 6/1987 | Santalla et al. | 110/213 |
| 4,683,541 | A | * | 7/1987 | David | 110/188 |

(List continued on next page.)

FOREIGN PATENT DOCUMENTS

| | | | |
|---|---|---|---|
| CA | 1161355 | * | 1/1984 |
| CA | 1188210 | * | 6/1984 |
| CA | 002023955 | * | 3/1991 |
| JP | 633118 | * | 1/1988 |
| SU | 1084537 | * | 4/1984 |
| SU | 1185021 | * | 10/1985 |

OTHER PUBLICATIONS

S. Soma, et al., Combustion and Flame, vol. 86, pp. 269–284, Reconstruction of Fire Whirls Using Scale Models, 1991.

F. Battaglia, et al., Combust. Theory Modelling, vol. 4, pp. 123–138, "Simulating Fire Whirls", 2000.

*Primary Examiner*—Henry Bennett
*Assistant Examiner*—Kathryn Ferko
(74) *Attorney, Agent, or Firm*—Oblon, Spivak, McClelland, Maier & Neustadt, P.C.

(57) ABSTRACT

Described is an apparatus for incinerating waste gas comprising; a plurality of combustion nozzles 20 arranged in periphery of an inner tube for discharging the waste gas into the combustion chamber, an incineration inner tube 30 for shielding the flare smoke, the flame light and the noise being generated during incineration of the waste gas and being discharged from the combustion nozzle 20, said incineration inner tube 30 having a plurality of air inlets 32 at its lower periphery, and an outer tube 40 for introducing the swirl air into the flame generation side for providing the swirl force to the combusted gas which is elevated within the inner tube 30, said outer tube 40 is provided with several air inlet passages 42 tangentially formed in communication with the incineration inner tube 30.

5 Claims, 5 Drawing Sheets

U.S. PATENT DOCUMENTS 5,220,794 A * 6/1993 Sledd et al. ..... 60/737
5,479,781 A * 1/1996 Fric et al. ..... 60/740
5,810,575 A * 9/1998 Schwartz et al. ..... 431/5
5,846,068 A * 12/1998 Schwartz et al. ..... 431/202
6,012,917 A * 1/2000 Wiseman ..... 431/154
6,146,131 A * 11/2000 Wiseman ..... 431/154
6,168,422 B1 * 1/2001 Motyka et al. ..... 431/186
6,216,610 B1 * 4/2001 Brunnmair et al. ..... 110/208

* cited by examiner

METHOD AND APPARATUS FOR INCREASING INCINERATION CAPACITY OF THE GROUND FLARES BY USING THE PRINCIPLE OF TORNADO

BACKGROUND OF THE INVENTION

1. Field of the Invention

The present invention is related to a method and an apparatus for incinerating waste gas generated in a chemical or refinery plant. More specifically the present invention is directed to a method and an apparatus for increasing the incineration capacity of the ground flares by using the principle of tornado, while maintaining the ground flare's main advantage, that is the ability to insulate the flaring smoke and noise from being observed and heard in the neighborhood of the ground flares.

Generally, a large amount of waste gas is produced when a process in chemical or refinery plant stops or re-starts. A flare system is an essential utility for most chemical plant, which is a device to convert the waste gas into a less harmful form before discharging the waste gas into the ambient air.

2. Description of the Prior Art

The ground flare illustrated in FIGS. 3*a* and 3*b* is a flare system adapted for a chemical plant. The basic construction of the ground flare consists of two circular tubes, i.e., a taller inner tube 10 and a shorter outer tube 12, which encloses the bottom portion of the inner tube 10.

The inner tube 10 serves as the wall of the combustion chamber for the waste gas incineration. An air passage is formed along the peripheral space between the inner tube and outer tube. The air, which first passed over the top of the shorter outer tube, enters the annular space between the inner and outer tubes, and then enters the combustion region inside the inner tube through the vertical air inlet placed along the periphery of the bottom of the inner tube. A combustor stack 14 is placed just inside of each vertical air inlet of the inner tube.

In each combustor stack 14, a plurality of combustion nozzles are placed facing the center of the combustion chamber in the vertical direction. The waste gas is injected through each combustion nozzle toward the center of the combustion chamber and is incinerated by the flames attached to the nozzles. The main function of the tube 10 is to form a space for the combustion chamber. At the same time, the inner tube 10 is adapted for preventing the smoke and noise, generated during the flaring operation, from being transmitted to the exterior of the combustion chamber. The outer tube 12, which encloses the lower end of the inner tube, shields the people working in the vicinity of the ground flare from the flare radiation. In addition, the outer tube also protects the flames from being blown away by the wind.

In comparison with the other types of flare systems, the ground flare provides the advantage of preventing the flaring smoke and noise from being transmitted to the exterior of the combustion chamber. The ground flare accomplishes this by using the inner tube as a constitutional element of the flare apparatus. Thus, it is possible to, in effect, mitigate the audiovisual environmental problems occurring during the flaring operation.

However, as seen from FIGS. 3*a* and 3*b*, the combustion chamber, in which the waste gas is incinerated, is shielded by the inner tube 10 and outer tube 12. Furthermore, the air required for incineration is introduced through the narrow space between the inner tube 10 and the outer tube 12.

Therefore, the air supply in the ground flare system is less efficient than the air supply in the other types of flares that carry out incineration in an open space.

Because of the relatively poor air supply to the combustion region, the ground flare has a lower incineration capacity per the amount of investment and per the installation area than the other types of open space flares have. Thus, in order to obtain a similar incineration capacity to that of open space flare systems, a higher facility cost is required, which is a drawback of the ground flare. Also, a relatively large amount of flaring smoke can be generated due to the deficiency of the air introduced into the combustion chamber.

SUMMARY OF THE INVENTION

The present invention was devised in consideration of the problems stated above. It is an object of the present invention to provide a method and an apparatus for increasing the incineration capacity of the ground flare, while preventing the flaring smoke and noise from escaping the combustion chamber, by employing the principle of tornado.

To this end, the method for incinerating the waste gas according to the present invention comprises the steps of:

(a) discharging the waste gas into the combustion chamber and incinerating said waste gas, and (b) introducing the swirl into the air supply for applying a swirl force to the combustion gas that is elevated by buoyancy.

The apparatus for incinerating waste gas according to the present invention comprises:

a plurality of combustion nozzles 20 stacked vertically just inside of the vertical opening of an inner tube for discharging the waste gas into the combustion chamber, an incineration inner tube 30 for containing the flare light, flare smoke and flare noise, generated during incineration of the waste gas discharged from the combustion nozzle 20, in the combustion chamber a plurality of air inlets 32 at the lower periphery of the inner tube 30, and an outer tube 40 for introducing the swirling air into the combustion chamber to apply a swirl force to the combusted gas that is elevated by buoyancy, said outer tube 40 is provided with several air inlets 42 formed in connection with the incineration inner tube 30 in the tangential direction.

DESCRIPTION OF THE PREFERRED EMBODIMENTS

The invention is designed on the basis of the principle by which tornados are formed. That is, when the buoyancy generated by the hot ground surface is combined with the swirl of the ambient air, an elevating swirling air stream is formed. The tangential velocity of the swirling air is then increased toward its center inversely proportional to the distance from the center according to the angular momentum conservation law. Thus, appealing to the Bernoulli's law, the pressure in the center portion, where velocity is higher, is decreased. With the decreasing pressure toward the center, the entrainment of the air from the periphery is enhanced. The flow with configuration of tornado is thus formed. Such buoyant swirling flow will have an air entrainment capacity higher than the buoyant flows, which do not involve swirl. Another advantage of the tornado flow configuration is that it is more robust to external flow disturbance because the hydrodynamic property of the buoyant swirling air stream is very stable.

The invention provides a method and an apparatus for incinerating waste gas in which the hydrodynamic principle of tornado is adapted to the incineration of waste gas.

The method of the invention for incinerating waste gas using the principle of tornado comprises the steps of: (a) discharging the waste gas into the combustion chamber and incinerating said waste gas; and (b) introducing the swirling air into the combustion region to apply a swirl force to the combusted gas that is elevated by buoyancy.

In the step of introducing the swirling air, it is preferable that the swirling air is introduced into the inner tube consisting a combustion chamber in the tangential direction.

The amount of air that is introduced into the combustion chamber is adjusted in consideration of the incineration and safety security conditions.

That is, if the incineration capacity is large, the amount of air being introduced can be increased, and if the incineration capacity is relatively small, the amount of air can be decreased, thereby obtaining the optimal combustion condition to minimize the flaring smoke and noise.

Figure 1A:
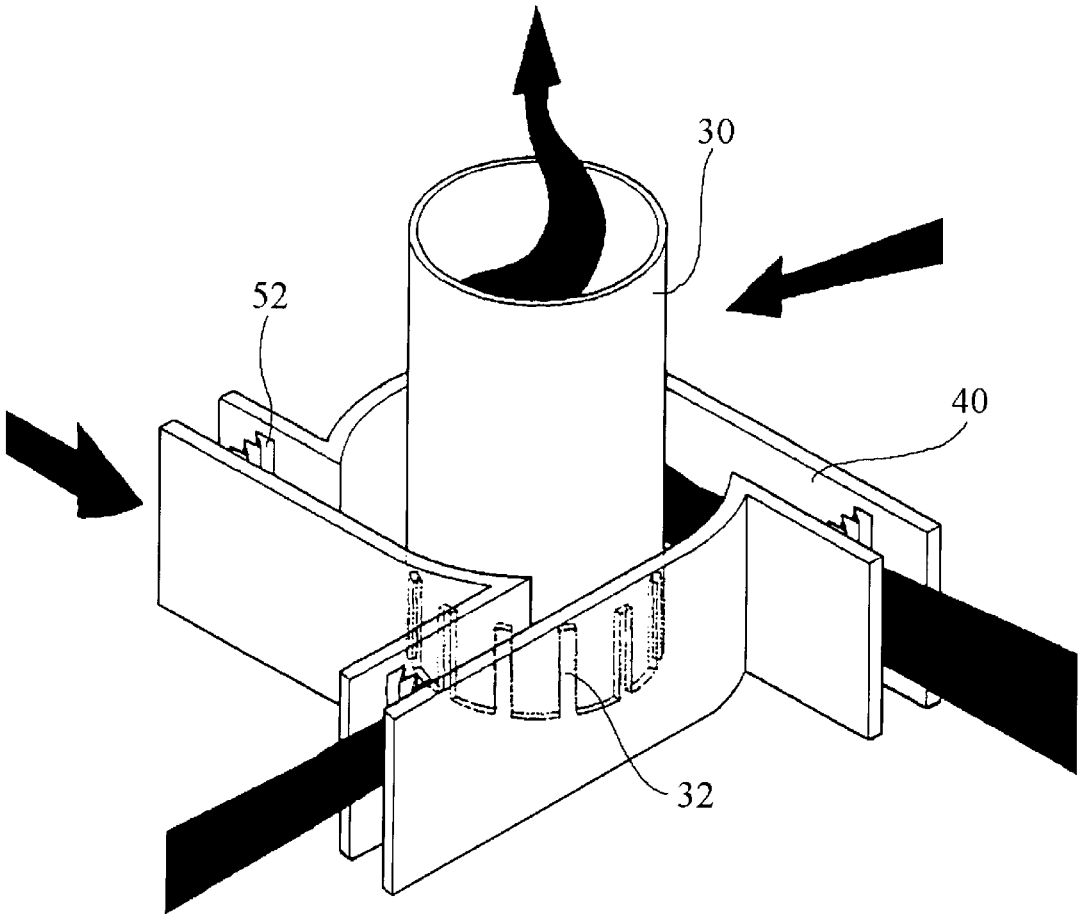
FIG. 1*a* is a schematic perspective view of an incinerator according to an example of the present invention.

The apparatus using the method mentioned above will be described in detail with reference to the embodiment illustrated in FIGS. 1*a*–2.

Reference numeral 20 denotes combustion nozzles, which serve to discharge the waste gas, produced in a chemical or refinery plant, into the combustion chamber.

A plurality of combustion nozzles 20 are arranged with an equal distance along the vertical stack that is placed just inside of the vertical air inlet of the inner tube. The jet flames from the combustion nozzles 20 are formed concentric toward the center of the combustion chamber.

Along the periphery of the inner wall on which the combustion nozzles are disposed, the incineration inner tube 30 is disposed in an uprightly manner. The incineration inner wall has a plurality of air inlets 32 arranged in the lower periphery thereof.

Each of the air inlets 32 is disposed so as to have an array of combustion nozzles 20, respectively. This is the reason that the swirling air introduced from the air inlet 32 can be firstly reached to the corresponding combustion nozzle stack.

On the lower periphery of the incineration inner tube 30, an outer tube 40 is arranged to introduce the swirling air into the combustion region inside of the air inlet 32 so that the combusted gas elevating from the incineration inner tube 30 produces a suction force with the aid of the swirling flow. Air inlet passages are provided on the outer tube 40, which is formed in tangentially to the incineration inner tube 30, and the number of air inlet passages is preferably four.

Means to adjust the air flow rate is provided in the inlet portion of the air inlet passage 42 in order to adjust the swirling force and the air flow rate into the combustion region.

The air flow adjustment means may include an open-close valve, which can be controlled electrically or hydraulically. The air flow adjustment unit may also consist of impellers 50 that can be opened-closed in a multi-stepped manner as shown in FIG. 2, or may consist of foldable door 52, which can be opened-closed in a foldable manner, as shown in FIG. 1*a*.

The following will illustrate the operation of the embodiment constructed.

When the waste gas is discharged from the combustion nozzles 20 and becomes in contact with the flames formed at the combustion nozzles, the waste gas is combusted within the combustion chamber and is elevated within the incineration inner tube 30 and then exhausted into the ambient air.

Figure 1B:
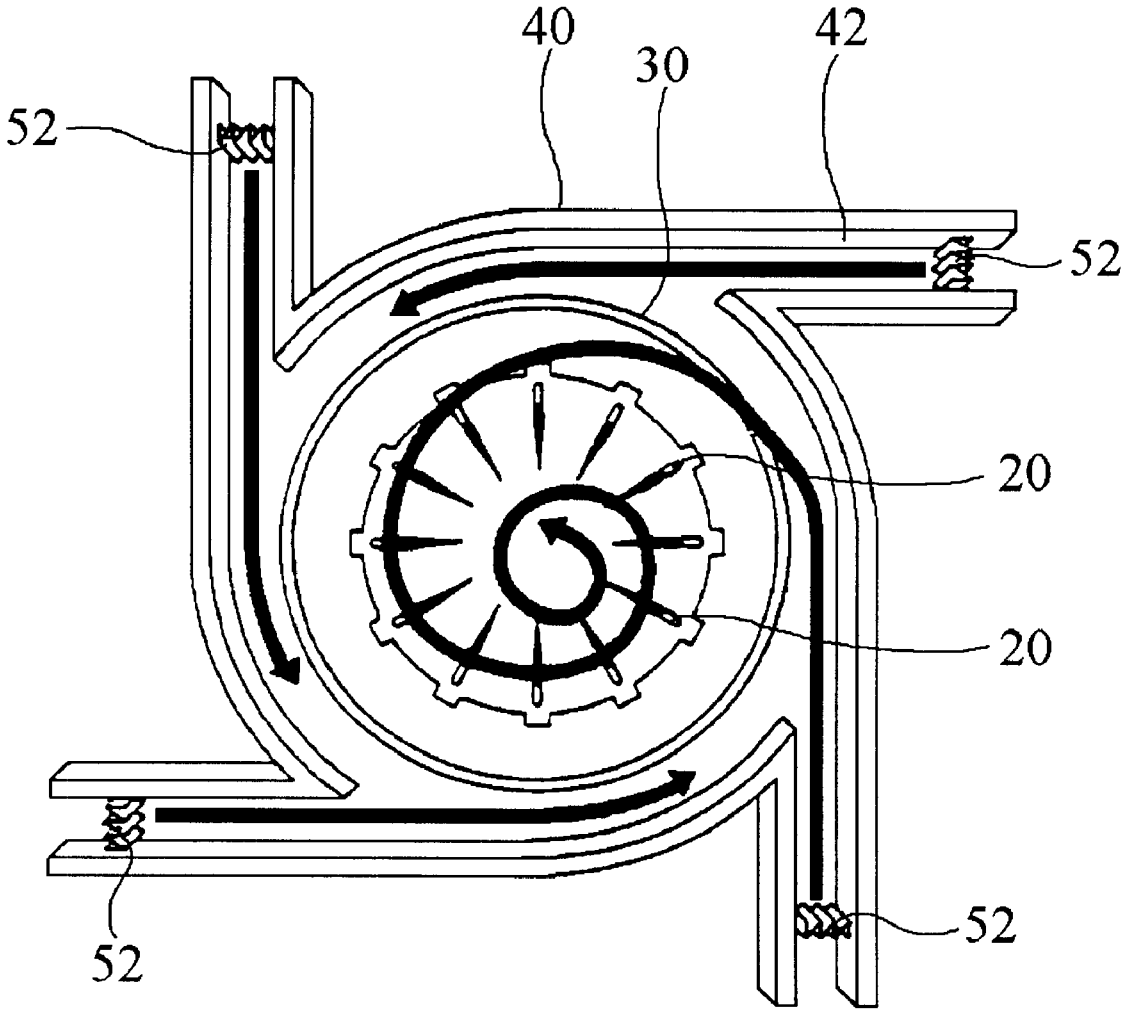
FIG. 1*b* is a schematic plan view of FIG. 1*a*, showing the streamline along which the swirling air is introduced to the inner combustion region.
Figure 2:
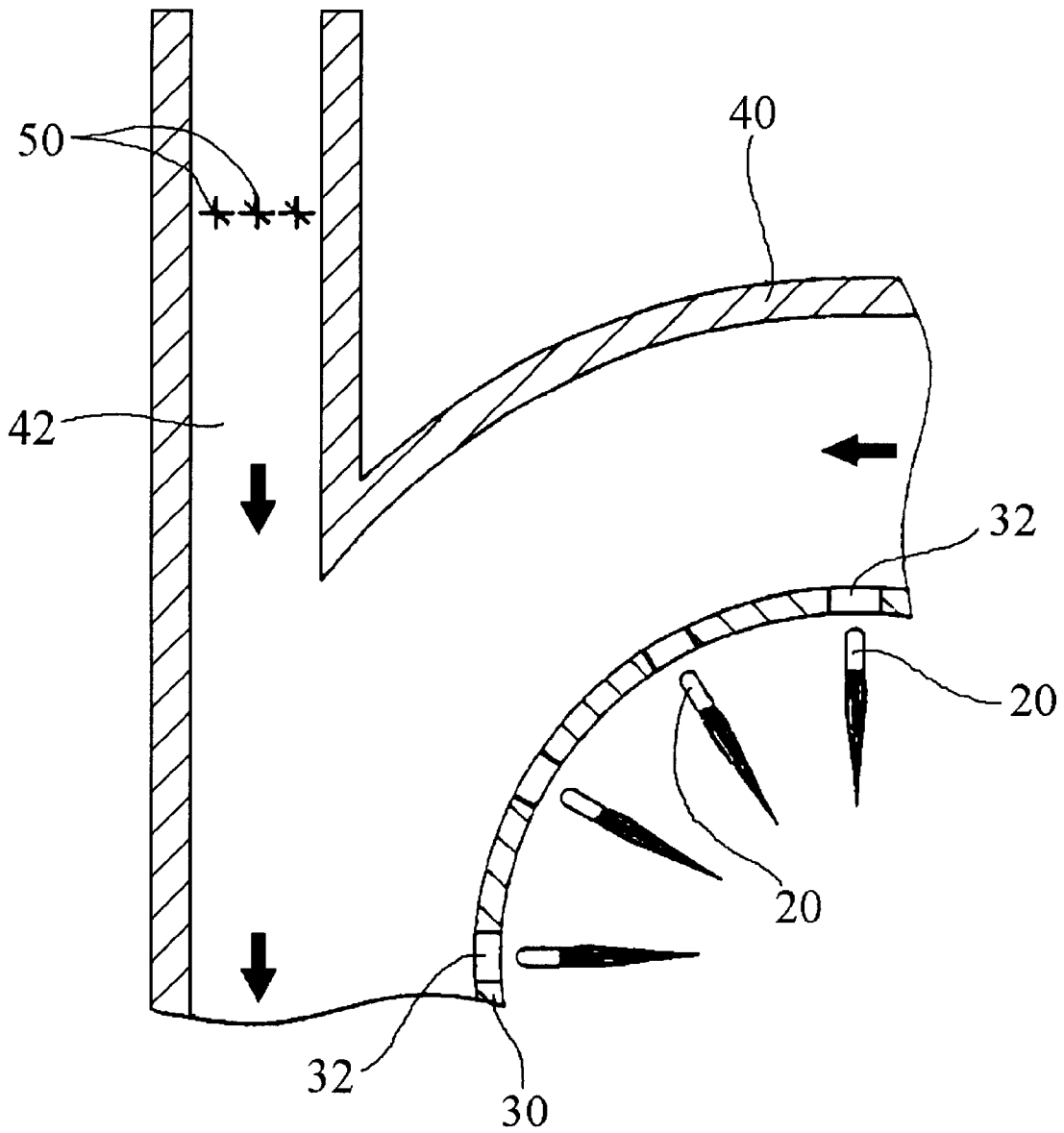
FIG. 2 is an enlarged view of the air inlet portion illustrated in FIG. 1*a;*
Figure 3A:
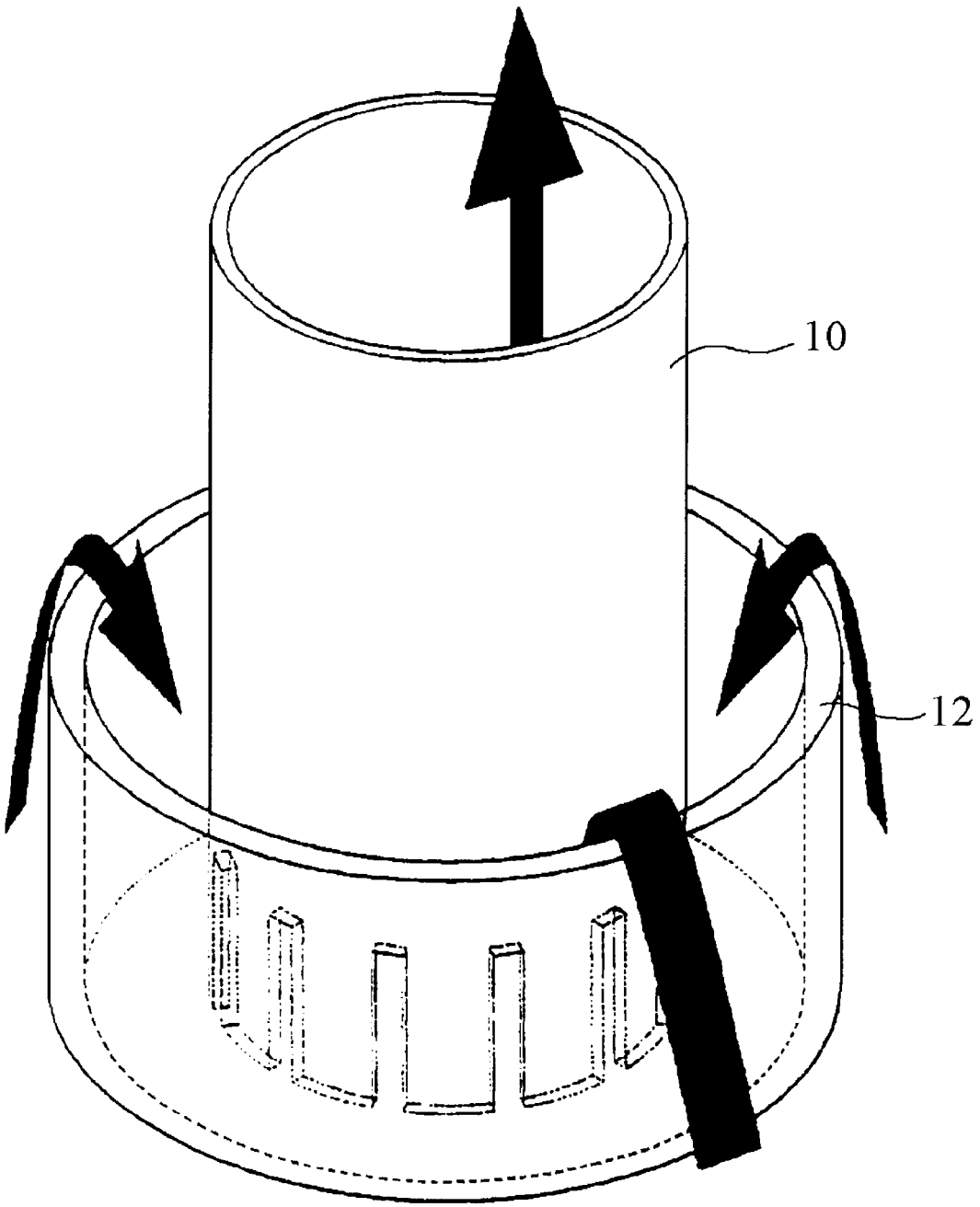
FIG. 3A (PRIOR ART)
FIG. 3*a* is a schematic perspective view of a ground flare according to the prior art.
Figure 3B:
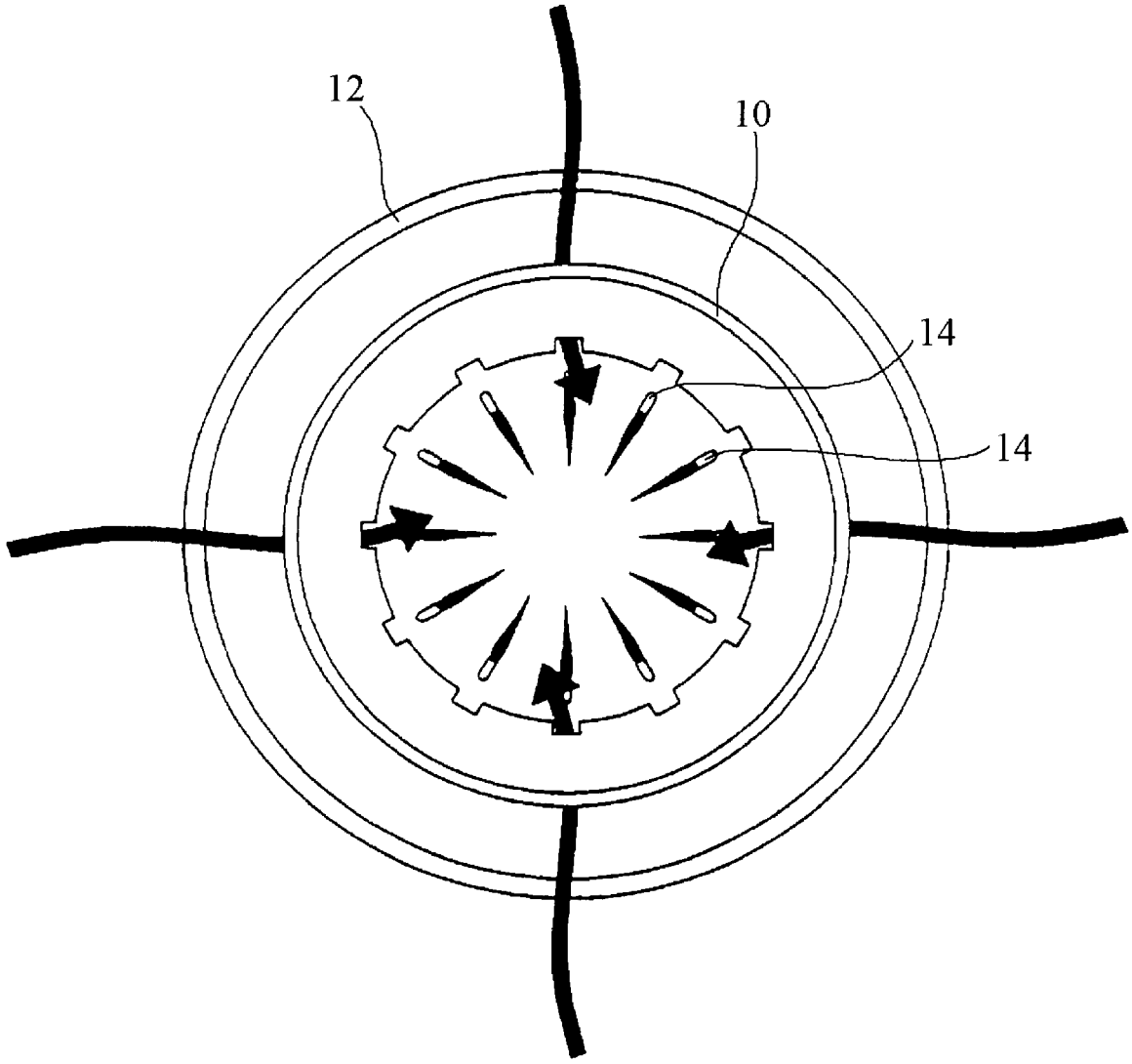
FIG. 3B (PRIOR ART)
FIG. 3*b* is a plan view of the ground flare shown in FIG. 3*a*.

The air being entrained into the air inlet passage 42 by the buoyancy generated by the combusted gas is then introduced to the incineration inner tube 30, wherein incineration is carried out, and then travels to the combustion chamber while swirled in counterclockwise as shown in FIG. 1*b*.

The combustion heat generated during incineration of the waste gas mixed with the air establishes strong buoyancy and produces a swirling air stream. The gas combusted within the combustion chamber through the above-mentioned process is then rapidly removed from the combustion chamber.

When the combusted gas is rapidly removed from the combustion chamber while being swirled upwardly, a pressure lower than that of the peripheral area is established in the inner portion of the combustion chamber, thereby enhancing the entrainment process of the ambient air.

At this time, the air flow rate and swirling force are adjusted by the rotary impellers 50 or foldable door 52 as an air adjustment means.

The swirling force of the air being introduced into the combustion chamber is combined with the buoyancy generated within the combustion chamber. Thus, they establish an elevating swirling air stream, similar to the hydrodynamic configuration of tornado.

Thus, the invention can considerably improve the maximum incineration capacity of the ground flare by enhancement of the introduction of air. Further, the invention improves cleaner combustion by reducing the flaring smoke that can be generated when the amount of the air supply is not sufficient.

As discussed above, according to the invention, the incineration capacity of waste gas can be increased by increasing the amount of air being introduced into the combustion chamber, and flaring smoke that may be generated under the conditions of air deficiency can be reduced.

Thus, the invention is preferably adapted to incinerate a large amount of waste gas at the time of system inspection of a chemical or refinery plant.

What is claimed is:

1. An apparatus for incinerating waste gas, comprising:

an incineration inner tube having a plurality of air inlets at its lower periphery, said incineration inner tube shielding flare, smoke and noise generated during incineration of the waste gas;

a plurality of combustion nozzles arranged in at least the lower periphery of the incineration inner tube configured to discharge the waste gas into a combustion region in the incineration inner tube; and an outer tube provided with several air inlet passages extending horizontally and formed in communication with the incineration inner tube in tangential directions and configured to introduce ambient air into the combustion region and to provide a swirl force to the air and combusted gas that are elevated within the incineration inner tube;

wherein said incineration inner tube extends a distance beyond an upper extent of the outer tube.

2. The apparatus of claim 1, wherein said apparatus further comprising an air adjustment means provided in the inlet portion of said air inlet passage for adjusting the amount of the air introducing into the combustion chamber and the swirling force.

3. The apparatus of claim 1, wherein each of the air inlets is disposed so that they correspond to each of the combustion nozzles, respectively.

4. The apparatus of claim 2, wherein said air adjustment means includes rotary impellers which can be opened-closed in multi-stepped manner.

5. The apparatus of claim 2, wherein said air adjustment means includes foldable door which can be opened-closed in foldable manner.

* * * * *